US006619046B1

(12) United States Patent
Mitchell

(10) Patent No.: US 6,619,046 B1
(45) Date of Patent: Sep. 16, 2003

(54) PULSE TUBE LINER

(76) Inventor: Matthew P. Mitchell, 151 Alvarado Rd., Berkeley, CA (US) 94705

( * ) Notice: Subject to any disclaimer, the term of this patent is extended or adjusted under 35 U.S.C. 154(b) by 0 days.

(21) Appl. No.: 10/198,554

(22) Filed: Jul. 19, 2002

(51) Int. Cl.[7] ..... F25B 9/00
(52) U.S. Cl. ..... 62/6
(58) Field of Search ..... 62/6

(56) References Cited

U.S. PATENT DOCUMENTS 5,335,505 A 8/1994 Ohtani
5,953,920 A 9/1999 Swift
6,347,453 B1 2/2002 Mitchell

OTHER PUBLICATIONS

Willems, D. W. J., et al. "Three Dimensional Pulse Tube Simulations", Advances in Cryogenic Engineering, (Kluwer Academic/Plenum Publishers, 2002) vol. 47A, pp. 934–941, at p. 939.

Yang, L. W. "Shuttle Loss in Pulse Tubes", Cryocoolers 11 (Kluwer Academic/Plenum Publishers, 2001), pp. 353–362, at "Loss due to Gas Piston Flow", p. 356 and "Loss Analysis—Comparison With Theoretical Refrigeration" at p. 361.

Yang, L. W. et al., "Theoretical Analysis of Refrigeration and Losses in a Pulse Tube" Advances in Cryogenic Engineering, (Kluwer Academic/Plenum Publishers, 2000) vol. 45A, pp. 175–182 at pp. 180–182.

Marquardt, E. D., et al. "Pulse Tube Oxygen Liquefier", Advances in Cryogenic Engineering, (Kluwer Academic/Plenum Publishers, 2000) vol. 45A, pp. 457–464 at section "Pulse Tube", p. 460.

Swift, G. W., et al. "Performance of a Tapered Pulse Tube", Cryocoolers 10 (Plenum Press, 1999) pp. 315–320.

Lee, J. M., et al., "Higher Order Pulse Tube Modeling", Cryocoolers 9 (Plenum Press 1997), pp. 345–353, Figures 2, 3, 4, and related text.

Lee, J. M., et al., "Steady Secondary Momentum and Enthalpy Streaming in the Pulse Tube Refrigerator", Cryocoolers 8, (Plenum Press, 1995), pp. 359–369, Summary, at pp. 365–366.

Jeong, S., Nam, K., Kim, M.G., Chang, H.–M., and Jeong, E.S., "Experimental Study of Heat Transfer in Pulse Tubes", Cryocoolers 11 (Kluwer Academic/Plenum Publishers, 2001), pp. 345–351, at p. 347.

*Primary Examiner*—Henry Bennett
*Assistant Examiner*—Malik N. Drake

(57) ABSTRACT

The pulse tube 59 of a pulse tube refrigerator is equipped with a thin liner 80 of low thermal mass and in poor thermal contact with pulse tube 59. One surface of liner 80 may be furnished with indented recesses 86, making the recessed portions of the liner thinner than the remainder of the material of liner.

19 Claims, 2 Drawing Sheets

PULSE TUBE LINER

GOVERNMENT RIGHTS

The invention was made with Government support under contract F29601-99-C-0171 awarded by the United States Air Force. The Government has certain rights in the invention.

CROSS-REFERENCE TO RELATED APPLICATIONS

Application Ser. No. 09/084,042 of Matthew P. Mitchell for Concentric Foil Structure for Regenerators.

1. Background—Field of Invention

The invention relates to liners for the walls of the pulse tube portions of pulse tube refrigerators.

2. Background—Description of Prior Art

Pulse tube refrigerators are regenerative gas cycle refrigerators typically used as cryocoolers, providing cooling at temperatures below about 120 Kelvin. Pulse tube refrigerators are characterized by a tube, called the "pulse tube" in which a compressible fluid, typically helium, is cyclically shuttled back and forth while the pressure of the fluid, and thus its temperature, is cyclically changing. One end of the pulse tube becomes warm as warm, compressed fluid repeatedly moves toward the warm heat exchanger, where heat is rejected. The other end of the pulse tube becomes cold as fluid at lower pressure repeatedly moves toward the cold heat exchanger, where heat is lifted from the cooling load. In operation, fluid in the pulse tube acquires a temperature gradient from one end of the pulse tube to the other end. The wall of the pulse tube likewise acquires a temperature gradient from its warm end to its cold end. However, due to movement of the fluid, the temperature at any point on the wall of the pulse tube is seldom the same as the temperature of the fluid in contact with it.

With in-line and U-tube configurations, the pulse tube must be strong enough to contain the internal pressure of the working fluid with a margin of safety. It must also be strong enough to handle the mechanical stresses that it will experience during assembly and operation. That ordinarily implies a minimum metal wall thickness of the order of 0.3 mm for refrigerators with a few watts of capacity and thicker walls for larger machines. Because metals have high diffusivity and substantial volumetric heat capacity, their thermal inertia is high. Thus pulse tube walls have much more thermal mass than the working fluid in the refrigerator, and their local temperatures change little over the course of a cycle. Heat transfer between the working fluid, in which temperature is constantly changing, and pulse tube walls, which remain essentially isothermal, seriously damps temperature swings in the fluid, especially in small-diameter pulse tubes, in which much of the fluid lies within a penetration depth from the wall of the pulse tube, and in low frequency refrigerators, in which heat transfer occurs over a relatively long time interval, thereby increasing penetration depths.

Heat transfer between fluid and pulse tube wall also tends to generate a "streaming" effect in the fluid in the pulse tube. Streaming causes fluid adjacent to the wall of the pulse tube to move toward its warm end; a balancing flow at the axis of the pulse tube moves from the warm end toward the cold end. Torroidal convection generated by streaming flows constitutes another loss mechanism that decreases cooling power and reduces efficiency of the refrigerator.

The adverse effects of temperature-swing damping and streaming have been recognized by others. A solution to the streaming problem been proposed. Olson and Swift have counteracted streaming with a carefully-calculated taper in pulse tube walls. (U.S. Pat. No. 5,953,920). That, however, does not prevent the adverse effects of heat transfer in damping temperature swings in the fluid.

Marquardt and Radebaugh have suggested the use of plastic liners in a pulse tube as a means of changing the volume of the pulse tube, and to reduce conduction losses. They also mention the possibility of tapering the liners to reduce streaming. ("Pulse Tube Oxygen Liquefier", Advances in Cryogenic Engineering, Vol. 45A, p. 457 at p. 460 (Kluwer Academic/Plenum Publishers 1999)). While not expressly noted by Marquardt and Radebaugh, the relatively poor heat transfer in plastic would permit its surface temperature to fluctuate somewhat more than would the wall of a metal pulse tube of equal thickness. However, the volumetric heat capacity of suitable plastic materials is substantial, and a plastic liner would need to be relatively thick to provide the structural strength required survive handling and to maintain its integrity in place. That would require substantial thermal mass in a plastic liner, providing no adequate solution to the temperature-swing damping problem. Moreover, the coefficients of expansion for plastic materials are substantially larger than for metals; the cold end of a plastic liner would contract more than a steel pulse tube in which it was installed, opening up a gap that would create undesirable "appendix gap" losses well understood in the Stirling Cycle engine art. No successful application of plastic pulse tube liners has been reported.

SUMMARY OF INVENTION

A thin liner fabricated from a strong material with relatively low heat capacity, preferably of metal, is installed in the pulse tube in close proximity to the pulse tube wall. Because the liner is in intimate contact with the fluid in the pulse tube, and because the fluid in the pulse tube is almost always in motion, heat transfer between the fluid and the liner is relatively good. Because the liner is in only intermittent contact with the wall of the pulse tube, and because the thin layer of fluid trapped between the liner and the wall of the pulse tube is stagnant, heat transfer between the liner and the wall of the pulse tube is relatively poor. Because the liner itself is thin, its heat capacity is low. Thus, the effect of heat transfers between the fluid and the liner is to substantially alter the temperature of the liner as well as the temperature of the fluid, raising the liner temperature as the fluid is cooled, and vice versa. The result is that the temperature difference between the fluid and the liner at any instant is less than it would otherwise be, and thus less heat is transferred back and forth between the liner and the fluid, resulting in a smaller change in the temperature of the fluid. That reduces thermodynamic losses due to damping of temperature swings in the fluid and reduces the tendency toward streaming that would otherwise occur in untapered pulse tubes.

OBJECTS AND ADVANTAGES

Several objects and advantages of this invention are:

(1) To reduce thermodynamic losses resulting from the damping effect of heat transfer between the pulse tube of a pulse tube refrigerator and the fluid in that pulse tube.

(2) To reduce thermodynamic losses resulting from streaming effects induced by heat transfer between the pulse tube of a pulse tube refrigerator and the fluid in that pulse tube.

(3) To provide simple, inexpensive means for reducing thermodynamic losses resulting from the damping effect of heat transfer between the pulse tube of a pulse tube refrigerator and the fluid in that pulse tube.

(4) To provide simple, inexpensive means for reducing thermodynamic losses resulting from streaming effects induced by heat transfer between the pulse tube of a pulse tube refrigerator and the fluid in that pulse tube.

Further objects and advantages will become apparent from a consideration of the following description and drawings.

DRAWING FIGURES

REFERENCE NUMERALS IN DRAWINGS

Figure 1:
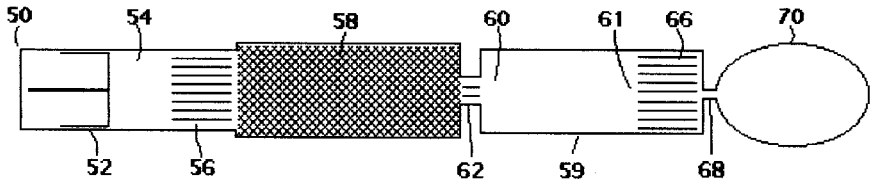
Fig. 1 (PRIOR ART)
FIG. 1 is a schematic view of a prior art linear pulse tube refrigerator.

50 pressure containment envelope
52 compressor
54 compression space
56 aftercooler
58 regenerator
59 pulse tube
60 cold end of pulse tube
61 warm end of pulse tube
62 cold heat exchanger
66 warm heat exchanger
68 orifice
70 reservoir
80 liner
82 joint
84 point of contact
85 recessed foil
86 indented recesses
88 full thickness portion
90 welded joint
91 first edge of welded foil
92 second edge of welded foil
94 butt joint
95 first edge of unbonded foil
96 second edge of unbonded foil Definitions For purposes of this patent, "foil" means a sheet of material that is thin in one dimension relative to its other two dimensions. "Surface" as applied to foil means one of the two surfaces of relatively large area, as distinguished from the edges, whose short dimension is approximately the thickness of the foil. "Smooth foil" means foil that is smooth on both sides and substantially the same thickness over its entire surface area. "Sculpted foil" means foil that has been sculpted, by photoetching or any other process, so that its thickness is different, at some points on its surface, from its thickness at other points on its surface, with one surface remaining smooth. "Recessed foil" means sculpted foil in which thinner areas of foil are surrounded by thicker areas of foil, as, for example, in a waffle pattern. "Recessed indentation" means an area of foil surface that is surrounded by an area of thicker foil. "Intermittent contact" as applied to the contact between a liner and a pulse tube, means contact at multiple locations distributed over the surface of the liner, but over a total area smaller than the total outer surface area of the liner. "Thermal mass" means heat capacity multiplied by mass, expressed in terms of the amount of heat required to change the temperature of the mass by a specified amount.

Figure 2:
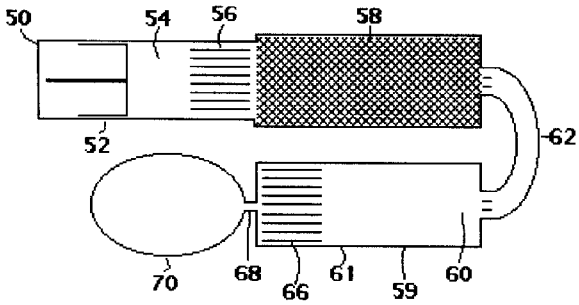
Fig. 2 (PRIOR ART)
FIG. 2 is a schematic view of a prior art U-tube pulse tube refrigerator.
Figure 3:
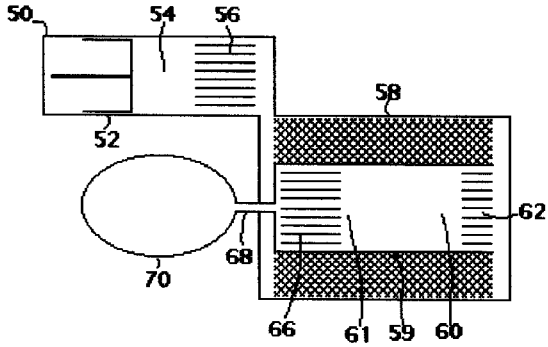
Fig. 3 (PRIOR ART)
FIG. 3 is a schematic view of a prior art coaxial pulse tube refrigerator.

Description—FIGS. 1, 2 and 3—Prior Art

FIG. 1 is a schematic representation of a prior art orifice pulse tube refrigerator in a linear arrangement. The pressure containment envelope 50 contains fluid in a compressor 52, compression space 54, aftercooler 56, regenerator 58, cold heat exchanger 62, pulse tube 59, warm heat exchanger 66, orifice 68 and reservoir 70. All of those components are connected to each other, allowing fluid to flow between them. Compressor 52 may be any device that can cyclically force a fluid, typically helium, to move back and forth through aftercooler 56. That motion in turn causes fluid to move back and forth through the other components of the refrigerator, in a pulse tube cooling cycle well known to the cryocooler art. In a linear pulse tube refrigerator, the wall of pulse tube 59 is part of the pressure containment envelope and its wall must be strong enough to contain the maximum pressure of the working fluid with a margin of safety.

FIG. 2 is a schematic representation of a prior art orifice pulse tube refrigerator in a U-tube arrangement. All of the components are as in FIG. 1 except for cold heat exchanger 62, which also serves as the duct that carries fluid passing between regenerator 58 and the cold end of pulse tube 60 through a 180 degree change in direction. Again, The wall of pulse tube 59 is part of the pressure containment envelope and its wall must be strong enough to contain the maximum pressure of the working fluid with a margin of safety.

FIG. 3 is a schematic representation of a prior art orifice pulse tube refrigerator in a coaxial arrangement. All of the components perform the same functions as in FIGS. 1 and 2. As in FIG. 2, fluid passing between regenerator 58 and the cold end of pulse tube 60 undergoes a 180 degree change in direction. However, the wall of pulse tube 59 is not part of the pressure containment envelope 50 and it need only be strong enough to withstand pressure differences between the inside of the wall of pulse tube 59 and regenerator 58, which surrounds pulse tube 59. Those pressure differences are typically around an order of magnitude smaller than pressure differences between the inside and outside of pressure containment envelope 50.

FIGS. 4–8—Preferred Embodiment

Figure 4:
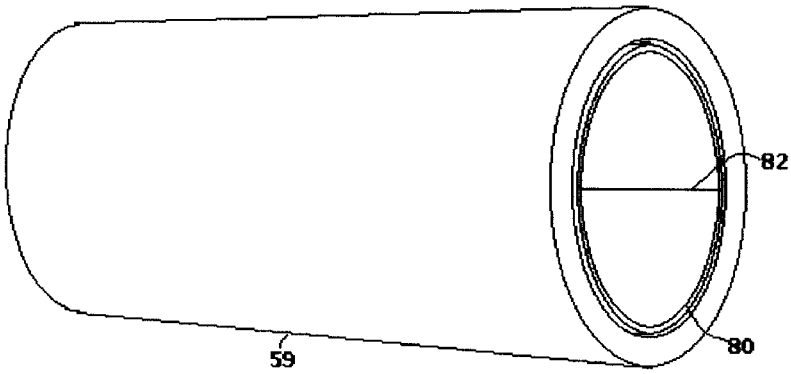
FIG. 4 is a perspective view of a pulse tube equipped with a foil liner of this invention.
Figure 5:
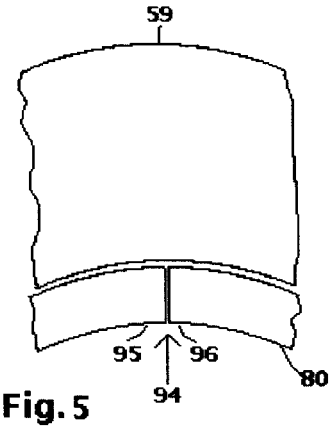
FIG. 5 is a schematic cross section of a portion of a liner with an unbonded butt joint.
Figure 6:
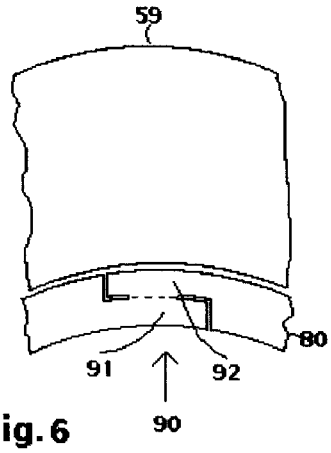
FIG. 6 is a schematic cross section of a portion of a liner with a welded joint.

In a preferred embodiment of this invention, shown in FIG. 4, a layer of liner 80 is installed in pulse tube 59, which may be a pulse tube of a linear pulse tube refrigerator as shown in FIG. 1, a U-tube pulse tube refrigerator as shown in FIG. 2 or a coaxial pulse tube refrigerator as shown in FIG. 3. Pulse tube 59 may be of any material. Pulse tube 59 will typically have a wall thickness of 0.15 mm or greater. Liner 80 will typically have a maximum thickness of about 0.055 mm or less. Joint 82 in FIG. 4 may be a butt joint as shown in FIG. 5 or a welded joint as shown in FIG. 6. Alternatively, a tube of similar thickness formed by any other process, would be equivalent. For lowest cost, liner 80 may be smooth stainless steel or titanium foil. Alternatively, where higher cost is justified, liner 80 may be recessed foil, preferably fabricated from 0.0254 mm 316 L stainless steel, full hard, or 0.0305 mm titanium foil etched in the pattern shown in FIG. 8, with foil in indented recesses thinned to about 0.010–0.015 mm. Hard contact between liner 80 and pulse tube 59 should be intermittent, as shown in FIG. 7.

FIG. 5 shows a portion of a cross-section of pulse tube 59 containing liner 80 of this invention. As shown in FIG. 5, joint 94 is a butt joint. Foil has been inserted into pulse tube 59 with first edge of unbonded foil 95 overlapping second edge of unbonded foil 96. Liner 80 has then been pressed out against the wall of pulse tube 59 until edges 95 and 96 have slipped past each other, using an inflated bladder, as shown, for example, in my prior patent No. 6,347,453, incorporated herein by reference. When the bladder is deflated and removed, the natural springiness of liner 80 holds first and second edges of unbonded foil 95 and 96 against the inner wall of pulse tube 59, causing those edges to butt up against each other at an unbonded butt joint 94.

FIG. 6 shows a portion of a cross-section of a pulse tube 59 containing the liner 80 of this invention. As shown in FIG. 6, joint 90 is a welded joint. First edge of welded foil 91 and second edge of welded foil 92 have been etched to create flanges approximately half the thickness of the thickest part of the foil. Those edges overlap to create a smooth joint no thicker than other parts of liner 80. The overlapping portions of edges 91 and 92 can be welded by laser welding or resistance welding processes known to the art. Liner 80, in the form of a tube, can then be inserted into pulse tube 59.

Figure 7:
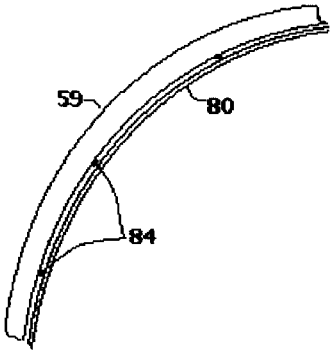
FIG. 7 illustrates points of contact between a pulse tube and a foil liner of this invention.

FIG. 7 shows a portion of a cross-section of a pulse tube 59 containing liner 80 of this invention. Liner 80, in the form of a rolled sheet with butt joint as shown in FIG. 5, a welded tube formed as shown in FIG. 6, or formed by another process, is installed in pulse tube 59 with a close fit. Small high spots in the surface of liner 80 and the inner wall of pulse tube 59 create points of contact 84, where the material of pulse tube 59 touches liner 80. At all other points on its outer surface, liner 80 is separate from pulse tube 59 by a small clearance filled with the working fluid of the pulse tube refrigerator, typically helium.

Figure 8:
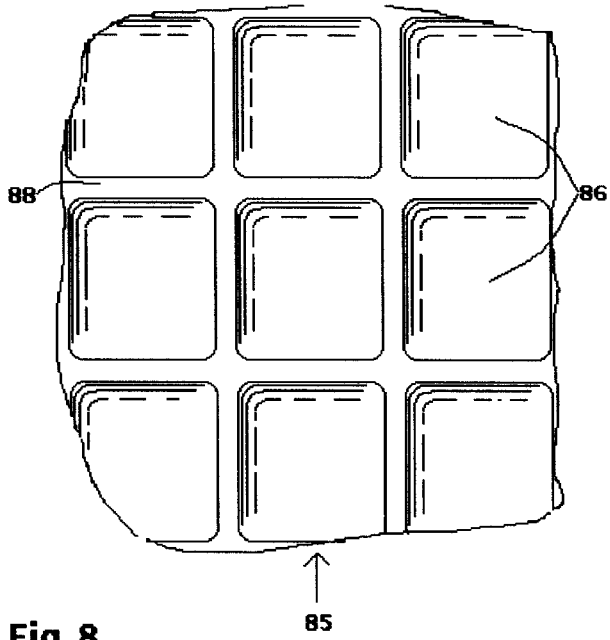
FIG. 8 is a view of the recessed side of a portion of a piece of recessed foil.

FIG. 8 shows a small portion of recessed foil 85, sculpted on the side shown by a process that produces indented recesses 86. Full thickness portions 88 of liner 80 surround each recessed portion 86. Photoetching is a preferred method of creating indented recesses 86 in recessed foil 85. When a photoetching process is used, full thickness portions 88 between indented recesses 86 must be wide enough to retain a photoresist during the etching process. Typically, that will require that full thickness portion 88 be at least 0.1 mm wide. Depth of etch in the indented recesses 86 is preferably at least half the thickness of the foil prior to etching. Width and length of indented recesses 86 are governed primarily by the structural requirements imposed by charge pressure of the working fluid and the ratio between highest and lowest pressures developed over the course of a cycle of operation. Liner 80 is thinner at the locations of the indented recesses, and when the foil is installed in a pulse tube, the indented recesses face the pulse tube wall. Thus, the portions of the foil that have been thinned by etching are not in contact with the wall of the pulse tube and are free to move in response to changing pressure in the pulse tube. Calculations to determine dimensions that will hold that motion within acceptable limits are known to the art. As an approximation, lengths and widths of indented recesses 86 of the order of 1–2 mm may be appropriate in some cases. Shapes of indented recesses may be square, rectangular, hexagonal or other shapes.

OPERATION

This invention improves pulse tube refrigerators. It employs a thin liner inside a pulse tube, but slightly separated from the wall of the pulse tube over most of its area so that the thermal contact between the liner and the pulse tube wall is minimized. The mass of the liner is as small as possible without compromising its structural integrity. The pulse tube itself is made of more substantial material and provides the main structural support for the liner; the liner need only support itself in position on the pulse tube wall. The small mass of thin liners minimizes their thermal inertia. That permits the temperature of the liner to float up and down over the course of the cycle, thereby reducing the temperature gradient between the working fluid and the liner. That, in turn, reduces adverse heat transfers to and from the fluid over the course of the cycle.

ADVANTAGES

This invention is a simple, inexpensive way to improve performance of pulse tube refrigerators. It is particularly advantageous where the temperature swing in the fluid is large, as is the case with pulse tube refrigerators running at relatively low frequencies in the range of 1–10 Hz and at relatively high pressure ratios in the range of 1.5 and higher. It is also particularly advantageous in smaller-diameter pulse tubes in which a larger portion of the fluid is within a penetration depth of the wall of the pulse tube, and thus subject to having its temperature damped by heat transfers to and from the surface to which it is exposed.

CONCLUSIONS, RAMIFICATIONS AND SCOPE

This invention improves upon prior art pulse tube refrigerators by reducing the thermal inertia of the surface in contact with fluid in the pulse tube. As a consequence, the temperature fluctuation in the surface in contact with the fluid in the pulse tube is greater than in prior art pulse tube refrigerators, reducing the amount of heat that is transferred back and forth between that surface and the fluid. By reducing heat transfers back and forth between the fluid in the pulse tube and the surface with which that fluid is in contact, this invention reduces thermodynamic losses resulting from damping of temperature fluctuations in the fluid in the pulse tube and convective losses caused by streaming induced by that heat transfer.

Although the description above contains many specifics, these should not be construed as limiting the scope of the invention but merely as providing illustrations of some of the presently preferred embodiments of this invention Thus, the scope of the invention should be determined by the appended claims and their legal equivalents, rather than by the examples given.

I claim:

1. In a pulse-tube refrigerator, an improvement comprising a linear in the pulse tube of said pulse tube refrigerator wherein said liner is in intermittent contact with the wall of said pulse tube, and wherein said liner has less thermal mass than does said pulse tube, and wherein substantial portions of said liner are less than 0.030 mm thick.

2. The liner of claim 1 wherein said liner comprises a tube.

3. The liner of claim 2 wherein said liner comprises a seamless tube.

4. The liner of claim 2 wherein said liner comprises a welded tube.

5. The liner of claim 1 wherein said liner comprises a sheet of foil installed in said pulse tube with an unbonded butt joint.

6. The liner of claim 1 wherein said liner is a metal liner.

7. The metal liner of claim 6 wherein the metal of said metal liner is selected from the group consisting of stainless steel and titanium.

8. In a pulse tube refrigerator, an improvement comprising a liner in the pulse tube of said pulse tube refrigerator wherein said liner is in intermittent contact with the wall of said pulse tube, and wherein said liner has less thermal mass than does said pulse tube, and wherein said liner has an outer surface in contact with said wall of said pulse tube, and an inner surface in contact with fluid in said pulse tube, and indented recesses on said outer surface.

9. The liner of claim 8 wherein the average distance between said outer surface and said inner surface is less than 0.055 mm.

10. The liner of claim 8 wherein the average thickness of said liner in said indented recesses is less than 0.030 mm.

11. The liner of claim 8 wherein said liner is a metal liner.

12. The metal liner of claim 11 wherein the metal of said metal liner is selected from the group consisting of stainless steel and titanium.

13. The metal liner of claim 11 wherein said metal liner comprises a tube.

14. The metal liner of claim 11 wherein said metal liner comprises a seamless tube.

15. The metal liner of claim 11 wherein said metal liner comprises a welded tube.

16. The metal liner of claim 11 wherein said metal liner comprises a sheet of foil installed in said pulse tube with an unbonded butt joint.

17. The metal liner of claim 11 wherein the average distance between said outer surface and said inner surface is less than 0.030 mm.

18. The metal liner of claim 11 wherein the average thickness of said metal liner in said indented recesses is less than 0.015 mm.

19. The metal liner of claim 11 wherein the average distance between said outer surface and said inner surface is less than 0.030 mm, and wherein the average thickness of said metal liner in said indented recesses is less than 0.015 mm.

* * * * *

UNITED STATES PATENT AND TRADEMARK OFFICE

CERTIFICATE OF CORRECTION

PATENT NO. : 6,619,046 B1
DATED : September 16, 2003
INVENTOR(S) : Matthew P. Mitchell It is certified that error appears in the above-identified patent and that said Letters Patent is hereby corrected as shown below:

Column 6,
Line 51, “linear” is corrected to read -- liner --.

Signed and Sealed this

Twenty-seventh Day of January, 2004

JON W. DUDAS
*Acting Director of the United States Patent and Trademark Office*